US006003869A

United States Patent [19]

Kuo

[11] Patent Number: 6,003,869

[45] Date of Patent: Dec. 21, 1999

[54] NUMBERS AND SETS GAME

[76] Inventor: Marie Ching-Hua Kuo, 3371 S. Monaco Pkwy, Denver, Colo. 80222

[21] Appl. No.: 08/489,000

[22] Filed: Jun. 8, 1995

[51] Int. Cl.[6] ..... A63F 3/00

[52] U.S. Cl. ..... 273/292; 273/259

[58] Field of Search ..... 273/244, 244.1, 273/259, 292

[56] References Cited

U.S. PATENT DOCUMENTS 4,480,840 11/1984 Chang ..... 273/292

5,106,100 4/1992 Yih ..... 273/292

OTHER PUBLICATIONS

"California Dominos", Casino Gaming Concepts, product brochure, 1994.

"Chinese Mah Jongg," World Wide Games, catalogue, p. 26, 1994.

"Hanafuda", Games and Puzzles, pp. 4 and 5, Nov. 1975.

*Primary Examiner*—William M. Pierce

*Attorney, Agent, or Firm*—Ramon L. Pizarro; Edwin H Crabtree

[57] ABSTRACT

A game and a method of playing a game involving skill and chance. The game of sets of tiles, each set having a numerical value ranging from one through nine and an icon or figure. Additionally, the game can also include a set of "lucky" or trump tiles that only include an icon, a die, a set of rulers for including the scoring values and aid in counting the tiles, and a chips for keeping score. The game includes 112 tiles, of the 112 tiles 36 tiles of one suit, meaning that these 36 tiles have similar icons, with four identical groups of nine tiles each, another 36 of the tiles is also made up of four identical groups of nine tiles of the same suit, and a third group of 36 tiles is four identical groups of nine tiles of the same suit. The balance, or four tiles, is made up of "lucky" or trump tiles. The process for playing the game involves distributing a randomly selected hand of tiles consisting of eight tiles when playing amongst two or three players, or eleven tiles when playing amongst four or more players. The game is played in rounds with the object being earning of points by winning rounds by completing hands that contain only groups of three similar or related tiles. The groups of three similar or related tiles is formed by taking turns in selecting and discarding tiles which can be used to complete a hand of nine or twelve similar or related tiles. The "lucky" or trump tiles can be used to win points, or a round if one player collects all four.

12 Claims, 5 Drawing Sheets

NUMBERS AND SETS GAME

BACKGROUND OF THE INVENTION (a) Field of the Invention

This invention generally relates to games whose object is to assemble groups items bearing the same or related numbers and the same or related indicia or suits. More particularly, but not by way of limitation, this invention relates to a game as well as the method for playing a game that uses a variety of tiles, each bearing an icon or design and a numerical representation, with the object of being the first player to complete a hand or set that is made up of certain pre-determined subsets, each subset having an established hierarchical point value.

(b) Discussion of the Prior Art

Games that use cards or tiles with icons and numbers have been very popular in the past. For example, with the well known card game of poker one uses a 52 card deck with an "ace" card with the value of one, numbered cards having values ranging from two to nine and "face" cards with numerical values that range from ten to thirteen. In addition to the 52 cards, poker card decks normally include a pair of jokers that can be used as "wild" cards, meaning that they can assume any value.

Each set of cards in a poker deck includes four suits. Each suit is represented by a specific symbol. For example, as is well known, the ace card comes in spades, clubs, hearts and diamonds. Point values are assigned to different hands or combinations of cards. The points earned for any one hand depend on the combination of cards that are dealt to the player. With cards, for example, the point value of combinations depends primarily on the numerical value of the cards, the order of the numbers and the suit of the hand.

The combinations for scoring points in most card games can be difficult to learn for younger children. Moreover, the numbers and suits used with many card games have little appeal to children. On the other hand, games that appeal to children usually do not provide enough opportunity for strategy and complexity to challenge adult players.

Therefore, there remains a need for a game that is easily learned and played by children or adults and that provides the opportunity of increased complexity and strategy, so that the challenges presented during play are simply a function of the cleverness of the players.

SUMMARY OF OBJECTS AND FEATURES

The present invention provides a versatile game that is easy to learn and presents opportunity for challenge that depends only on the strategic abilities of the players. A preferred version which can be played by four players includes 112 tiles. Each tile includes an icon, and most tiles include an icon and a number. A preferred embodiment of 112 tiles is made up of three sets of tiles, each having 36 tiles and one set of four "lucky" or trump tiles. Each set of 36 tiles is in turn made up of four identical subsets, each having nine tiles that include a number and an icon such as a figure. Tiles with the same or similar icon are said to be of the same suit.

In addition to the tiles, the game also includes one die or random number generator, chips for keeping score, and rulers with scoring guides to assist the players in evaluating their combinations of tiles and for assisting in forming rows of tiles with the appropriate number of tiles per row.

In a preferred embodiment one of the sets of 36 tiles has four groups of nine tiles each. Each tile has a face that includes a number from one through nine and the image of a baseball player in an action position. For example, in a preferred embodiment, one of the tiles in this set has the number seven and the figure of a baseball player getting ready to catch a ball, and another tile has the number one and the image of a pitcher getting ready to pitch. Thus, in a preferred embodiment of the invention the four groups of tiles numbered from one through nine and having the image of a baseball player total 36 tiles for this suit. These 36 tiles included in this embodiment will be referred to herein as the first set of 36 tiles.

Another of the three sets of 36 tiles also has four identical groups of nine tiles. Each group of nine tiles has a face that includes a number from one through nine and the image of a baseball. For example, in a preferred embodiment, one of the tiles in this set has the number six and the figure of a baseball, and similarly, another tile has the number one and the image of a baseball. Thus in a preferred embodiment of the invention the four groups of tiles numbered from one through nine and having the image of a baseball total of 36 tiles of this suit. These 36 tiles included in this embodiment will be referred to herein as the second set of 36 tiles.

The third group of sets of 36 tiles is, again, three groups of nine tiles each group. Each tile of the three groups has a face that includes a number from one through nine that is represented by several icons; the number of icons being the same as the number on the tile. For example, in a preferred embodiment, one of the tiles in this set represents the number six and, therefore, has six bats on its face. Another tile represents the number one, and, therefore, has only one bat shown on its face. Thus in a preferred embodiment of the invention the four groups of tiles numbered from one through nine with a matching number of icons total 36 tiles of this suit. These 36 tiles included in this embodiment will be referred to herein as the third set of 36 tiles.

Finally, the set of four "lucky" or trump tiles have a figure and no numerical value. Therefore, it can be seen that a preferred embodiment of the invention includes a total of 112 tiles, one die, chips, and four rulers with scoring information.

According to another aspect of the invention, a process for playing a game amongst two, three or four players is taught. In accordance with this aspect, four players can play with a game with pieces having the characteristics of the preferred embodiments described above. The object of the game is simply to accumulate the most points by assembling groups of related tiles during each round of the game. As was noted earlier, the players may keep a tally of the score with chips that represent points.

To earn points a player must first complete a predetermined number of groups of related tiles or must have drawn "lucky" tiles. The player will be awarded points depending on the difficulty or odds against combining certain groups. "Lucky" tiles are worth one point each regardless of the number of "lucky" tiles collected. Tiles are said to be related when they are the same or when they have consecutive numbers and are of the same suit. A set of related tiles for which points are awarded is called a "combo." Combos are typically made up of three related tiles. Therefore, points can be earned only after a player has completed a predetermined number of combos or by drawing "lucky" tiles.

To play a game with four players, all 112 tiles are mixed together face down. The tiles are then divided up into four groups having 28 tiles in each group. Each player should then receive one group of 28 tiles. The players then each stack the 28 tiles face down in the shape of a row that is 14 tiles long and two tiles high. In order to facilitate the forming of these stacks, the rulers can preferably include markers that correspond to the width of 14 tiles that have been laid side to side.

Once the rows have been formed, a player who has been designated as the first player cuts or divides the row in front of her. The cut is accomplished by simply rolling the die to obtain a number that represents the tile position where the first player is to divide her row of tiles. Thus, if the first player rolls a three, for example, then she would count three tiles from the right end of the stack (the end in front of the first player's right hand shoulder) and separate out these six tiles (each stack is two tiles high). The first player then separates the next four tiles and places them in front of her in a manner that will not allow others to see the contents of the face of the tiles.

After the first player has drawn these four tiles from the row in front of her, the player who is seated at her right then draws four tiles from the balance of the stack of in front of the first player. This second player also assembles the tiles in front of her in a manner that does not allow others to see the face of the tiles she drew. The process continues with the third player; the third player being the person seated to the right of the second player. The third player then separates the next four tiles from what remains of the stack in front of the first player. The fourth player does the same as the previous players, unless the stack in front of the first player has been depleted. If the stack in front of the first player has been depleted the player then continues to draw from the stack in front of the player that is to the right of the first player.

The above process for drawing four tiles at a time is repeated. After each player has drawn eight tiles each player then draws two more tiles following the same order that was used in drawing the first eight tiles.

After each player has drawn ten tiles, the first player will then draw two more tiles, and the rest of the players will draw only one tile. These tiles are drawn in the same order as the first ten tiles. At this point the first player should have 12 tiles, and all other players should have eleven tiles each. The set of tiles distributed to the players is called a "hand." The remaining, undistributed tiles define a "bank" of tiles.

The game is played in rounds, and can be played for one or as many rounds as is desired. Rounds begin with the shuffling of the tiles and the distribution of hands, and ends when a player wins the round. In order to win a round a player must either (1) hold a hand that is made up entirely of combos or (2) have drawn all four "lucky" tiles. The situation where a player posses a hand that is made up entirely of combos was described earlier herein as a predetermined number of combos.

There are only two kinds of combos, these are the "triplet" and the "sequence." A triplet combo is three identical tiles, meaning same suit and same number. A sequence is a combo that is made up of three consecutive tiles of the same suit.

As will be discussed in more detail below, the number of tiles in a hand will vary depending on the number of players in the game. Therefore, the pre-determined number of combos that can be assembled with a hand will vary with the number of players in the game. It is for this reason that one of the conditions for winning a round has been described as being the assembly of a pre-determined number of sets (combos), instead of specifying the number of sets.

After each player receives a hand of tiles, each player privately studies his or her tiles to determine if they have any of the "lucky" tiles. If they have "lucky" tiles, these should be turned over and exposed, or "laid down." Therefore, beginning with the first player and rotating to the right, the players declare whether they have "lucky" tiles, turn these over ("lay down") and draw a replacement tile from the bank. Each player that lays down a "lucky" tile will be awarded one point for each "lucky" tile laid down. If a player happens to hold all four "lucky" tiles, she will be declared an instant winner and be awarded four points.

Players can form combos from the 11 tile hand that was initially distributed to each player. Consequently, since the first player is the only player to hold 12 tiles immediate after the distribution of the tiles, the first player is the only player who has a chance of assembling a hand with four combos at the outset. In other words, the first player will be the only player that can be an instant winner by completing four combos immediately after the distribution of the hands. However as stated earlier, the other players, as well as the first player, can also become an instant winner by drawing all four "lucky" tiles in their initial hand.

If no player has collected all four "lucky" tiles, the first player to assemble a hand that is made up entirely of combos is the winner for that round and is awarded points according to the points schedule included below. No other player will be awarded points for that round, regardless of how many combos they have in their hand. However, each player will be able to get credit for the "lucky" tiles that they drew.

To assemble a wining hand a player must discard tiles that do not help the player assemble combos, and the player must try to substitute these tiles with new tiles that help the player in forming combos. A player can obtain new tiles in one of three following ways, (1) by drawing new tiles from the bank; (2) by "picking up" tiles discarded by the player who played immediately before the player who now seeks a new tile; and, (3) by "taking" tiles whenever possible.

Therefore, as used herein, when a player "draws" a tile he or she simply selects the next available tile from the bank. When a player "picks up" a tile, he or she is claiming the tile that had just been discarded by the player immediately before him or her. When a player "takes" a tile, he or she is claiming a tile that has just been discarded by another player and the player now claiming the tile will use the tile just taken to assemble a "triplet" combo. As stated earlier, triplets are combos that are made up of three identical tiles.

Hence, when playing the game each player will try to be the first to assemble a winning hand by exchanging the unwanted tiles in their hand. The exchanges will be accomplished by drawing, picking up, or taking tiles. When a player claims a new tile, the new tile will bring the total number of tiles in the possession of that player to 12 tiles. Therefore, unless the 12th tile is the tile that allows the player to win by forming four sets of combos (each having three tiles), she must discard one tile in order to bring the number of tiles in her possession back down to 11 tiles.

The tile that is discarded must be discarded with its face up. Once it is discarded the another player may claim the discarded tile. Tiles that have been discarded may be claimed by another player who "takes" or "picks up" the tile to form a combo. If the tile is not immediately picked up immediately after it was discarded, then the tile becomes a "dead" tile and may not be used again.

The game continues in a counterclockwise order until one of the players forms a hand that is made up entirely of combos. A player who draws a tile from the bank may draw a tile that furthers the forming of combos, does nothing towards the forming of combos, or is a "lucky" tile. In the event that a player draws a lucky from the bank, that player must lay down the lucky face up and draw another tile. The new tile drawn will bring the number of tiles in the possession of the player to a total of 12 tiles. Therefore, unless the tile just drawn makes the player a winner, the player must discard one of the tiles in order to bring the number of tiles in the possession of the player back down to 11 tiles.

The game is played for as many rounds as is desired. Points are earned each round depending on the number of "lucky" tiles obtained or the kind of combos that are grouped in the winning hand. Each round begins with the shuffling and distributing of the tiles and ends when one person has drawn all four "lucky" tiles or has formed four sets of combos. The winner of the game being the person who scores the most points at the end of all rounds played.

The game can also be played with two or three players. To play with three players the number of tiles used is reduced by eliminating one of the suits and eliminating the "lucky" tiles. Therefore, when playing among two or three players there will remain two sets of 36 tiles, each set having a different suit for a total of 72 tiles.

In order to form the bank with three players, three rows, each twelve tiles long and two tiles high should be formed. The first player should then roll the die in order to establish the cut. The tiles are then distributed, beginning with the first player receiving the first stack of four tiles that follows the cut, the second player receiving the second stack of four tile, and third player the third stack. The process is repeated until all players have eight tiles, and then the first player picks up one more tile. This means that at the beginning of the game the first player will have nine tiles and the rest of the players will have eight tiles.

When two individuals play the game, the rules and process are unchanged. The object still is to win rounds by being the first player to hold a hand that is made up entirely of combos. The same 72 tiles are used when playing amongst two players as are used when playing amongst three players. However, when forming the bank for two players, two rows, each eighteen tiles long and two tiles high should be formed. The first player should then roll the die in order to establish the cut. The tiles are then distributed, beginning with the first player receiving the first stack of four tiles that follows the cut and the second player receiving the following stack of four tiles. The process is repeated distributing stacks of four until both players have eight tiles, and then the first player picks up one more tile. This means that at the beginning of the game the first player will have nine tiles and the other player will have eight tiles.

The object and rules regarding how to earn points are not significantly altered when playing with two players. The only change when playing amongst two players is that the "lucky" tiles are no longer used. Also, when playing among two players, the rules allowing the "picking up," "taking," and advancing out of turn are no longer needed.

Thus, it can be seen that it is an object of the instant invention to provide a versatile game that can be challenging to those with few game skills as well as those with highly developed game skills.

Also, it is an object of the invention to provide an entertaining game that can be played for as many rounds as is desired and, therefore, for as long as desired.

It is still another object of this invention to provide a game that involves chance and skill.

It yet another object of this invention to provide a game that can be played in almost any language with substantially the same pieces.

Thus it can be appreciated the instant invention can achieve objects and advantages that were not achievable with the prior art. These and other objects and advantages of the present invention will become apparent to those skilled in the art from the following detailed description and accompanying drawings, showing the contemplated novel construction, combinations and elements as herein described, and more particularly defined by the appended claims, it being understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

Figure 1:
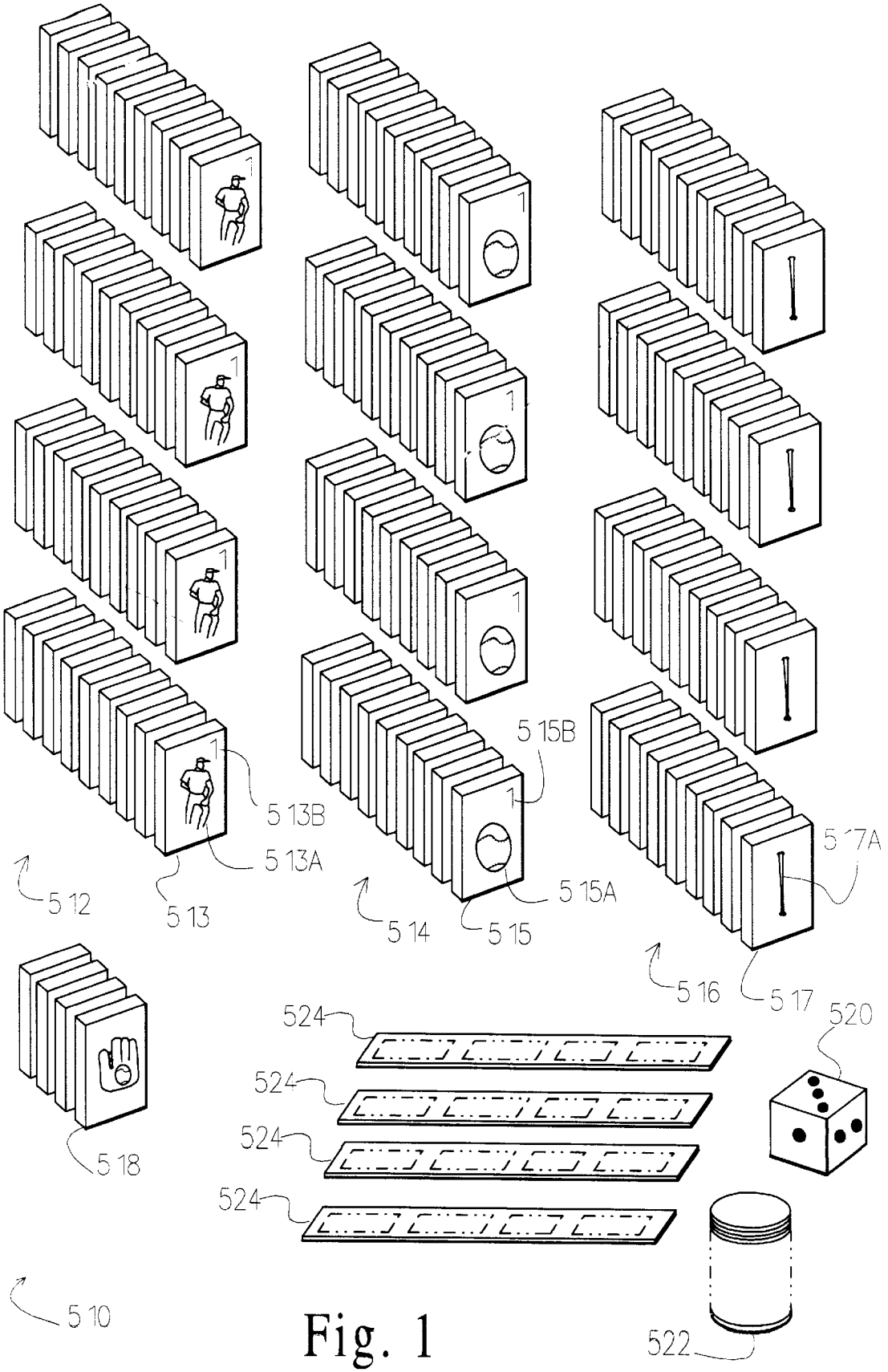
FIG. 1 is a pictorial illustration showing an isometric view of the game pieces of the present invention.
Figure 6:
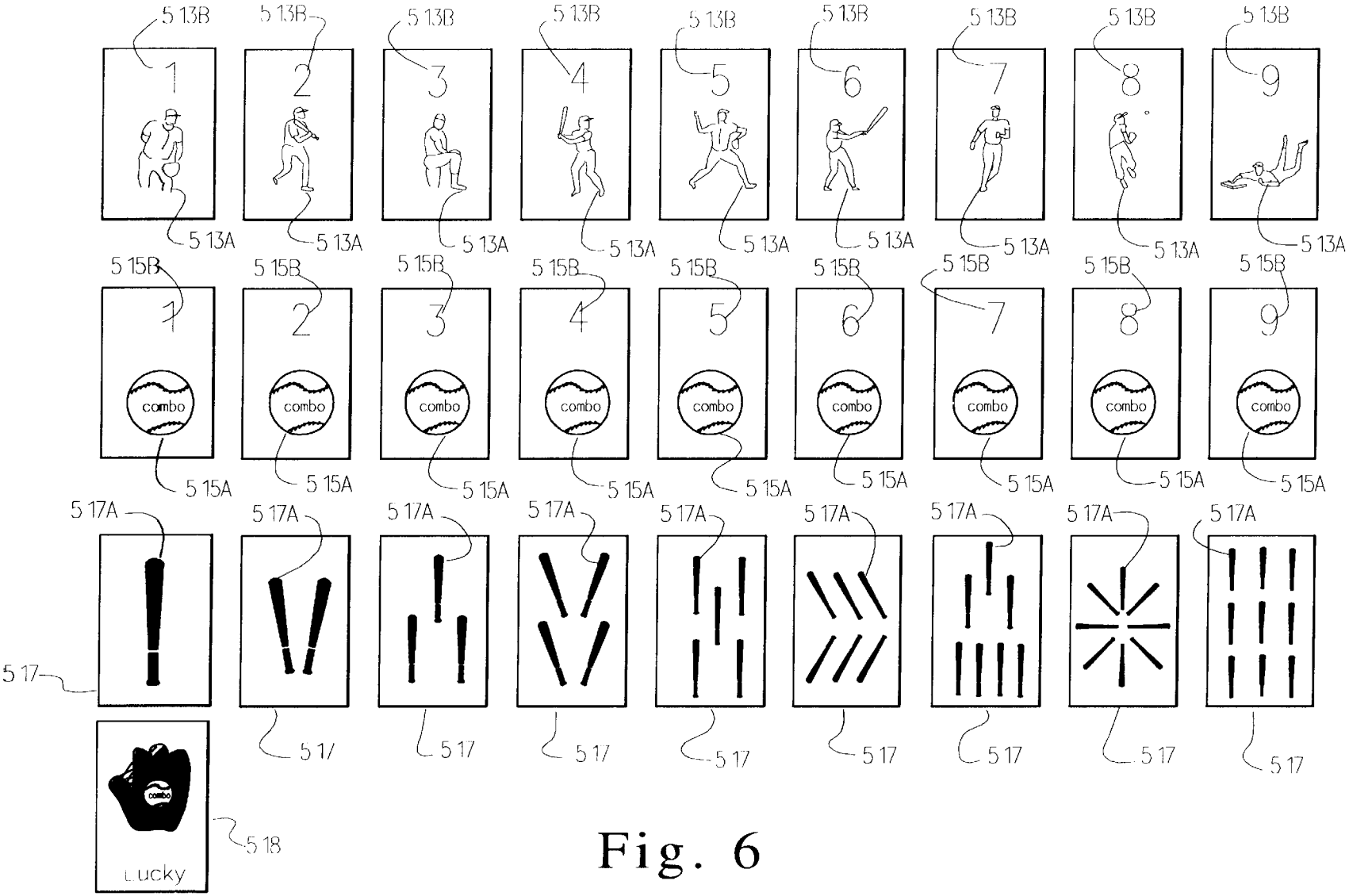
FIG. 6 is a pictorial illustration showing a preferred embodiment of the faces of the tiles of the present invention.

A preferred set of game pieces of the present invention is shown on FIG. 1 and is referred to in general with the numeral 510. As can be seen on FIG. 1, a preferred embodiment of the instant invention 510 includes one hundred and twelve (112) tiles. Of the 112 tiles, a first set of tiles 512 includes thirty six (36 ) tiles, and is made up of four identical groups of a first series of nine tiles 513. The series of nine tiles 513 includes tiles with an icon 513A and a numerical value 513B, which has been shown on FIG. 6. In a preferred embodiment this first set 512 of 36 tiles includes icons 513A having the image of a baseball player and numerical values 513B ranging from one through nine. As used herein, a set of tiles with the same or similar icon are said to be of the same suit. For example, in a preferred embodiment of the first series of nine tiles 513 the tiles have icons 513A including the image of baseball players in different positions, but are all in the same suit (the baseball player suit).

A second set of tiles 514, which also makes up part of the 112 tiles used in the invention 510, is also made up of thirty six (36 ) tiles. This second set is made up of four identical sets of a second series of nine tiles 515. In a preferred embodiment this second series 515 also has an icon 515A and a numerical value 515B from one to nine, which has been shown on FIG. 6. In a preferred embodiment the second series includes icons with the image of a baseball, thus defining a suit having the image of a baseball.

Figure 2:
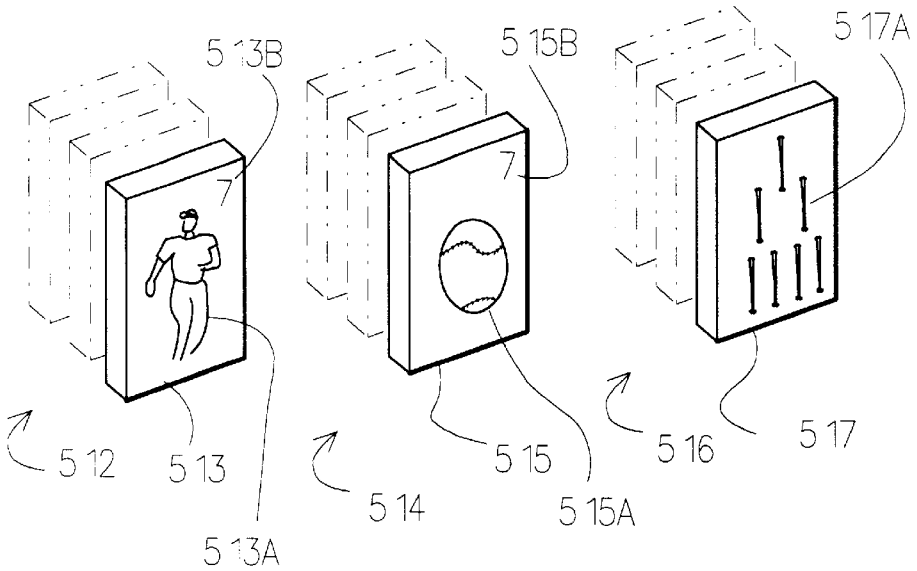
FIG. 2 is a pictorial illustration showing an isometric view of different game pieces, including pieces that have values that are different from the values shown on pieces shown on FIG. 1.

A third set of tiles 516, which also makes up part of the 112 tiles used in the invention 510, is also made up of thirty six (36 ) tiles. This third set 516 is made up of four sets of a third series of nine tiles 517. In a preferred embodiment this third series 517 includes a numerical value which is also represented by an equivalent number of icons 517A, which has been shown on FIG. 6. For example, in a preferred embodiment shown on FIG. 2, a tile of the third series 516 having the number seven also includes the icon 517A of the image of seven baseball bats. Similarly, as shown on FIG. 1, a tile from the third set of tiles 516 and having the number one also includes an icon 517A including the image of one baseball bat.

A final set of tiles which makes up the 112 tiles of a preferred embodiment of this invention 510 is a set of four "lucky" or trump tiles 518. This set of four tiles 518 can include an icon 518A, and in a preferred embodiment includes an icon representing a baseball glove, as is shown on FIG. 1. A preferred embodiment of the game also includes a die 520, which serves as a random number generator, a set of chips 522 for keeping score, and at least one ruler 524 with graduations which correspond to the width of a desired number of tiles laid side to side and for counting tiles and scoring guides to assist the players in evaluating their combinations of tiles.

According to another aspect of the invention, a process for playing a game with the invention 510 amongst two, three or four players is taught. In accordance with this aspect, four players can play with a game with tiles having the characteristics of the of the preferred embodiment 510 described above. The game is played in rounds, with the object of the game being the accumulation of the most points at the end of all rounds played. The game can be played for one round or as many rounds as desired The winner of each round played is awarded points for being the first one to complete four sets of three related tiles or for collecting lucky tiles 518. Points are awarded in relation to the difficulty of assembling a particular group of related tiles. Each of the players may keep a tally of the score with chips 522 that represent points.

To earn points a player must complete a set or sets or related tiles or from drawing "lucky" tiles 518. Tiles are said to be related when they are the same or have consecutive numbers and are of the same suit. A set of related tiles that may result in a point value is called a "combo." There are two types of combos for which points can be awarded, these are the "triplet" and the "sequence." A triplet is a set of three identical tiles. A sequence is a set of three tiles with consecutive numbers and icons belonging to the same suit.

In order to win a round a player must either (1) hold a hand that is made up entirely of combos or (2) have drawn all four "lucky" tiles. The situation where a player posses a hand that is made up entirely of combos was described earlier herein as a predetermined number of combos.

Figure 3:
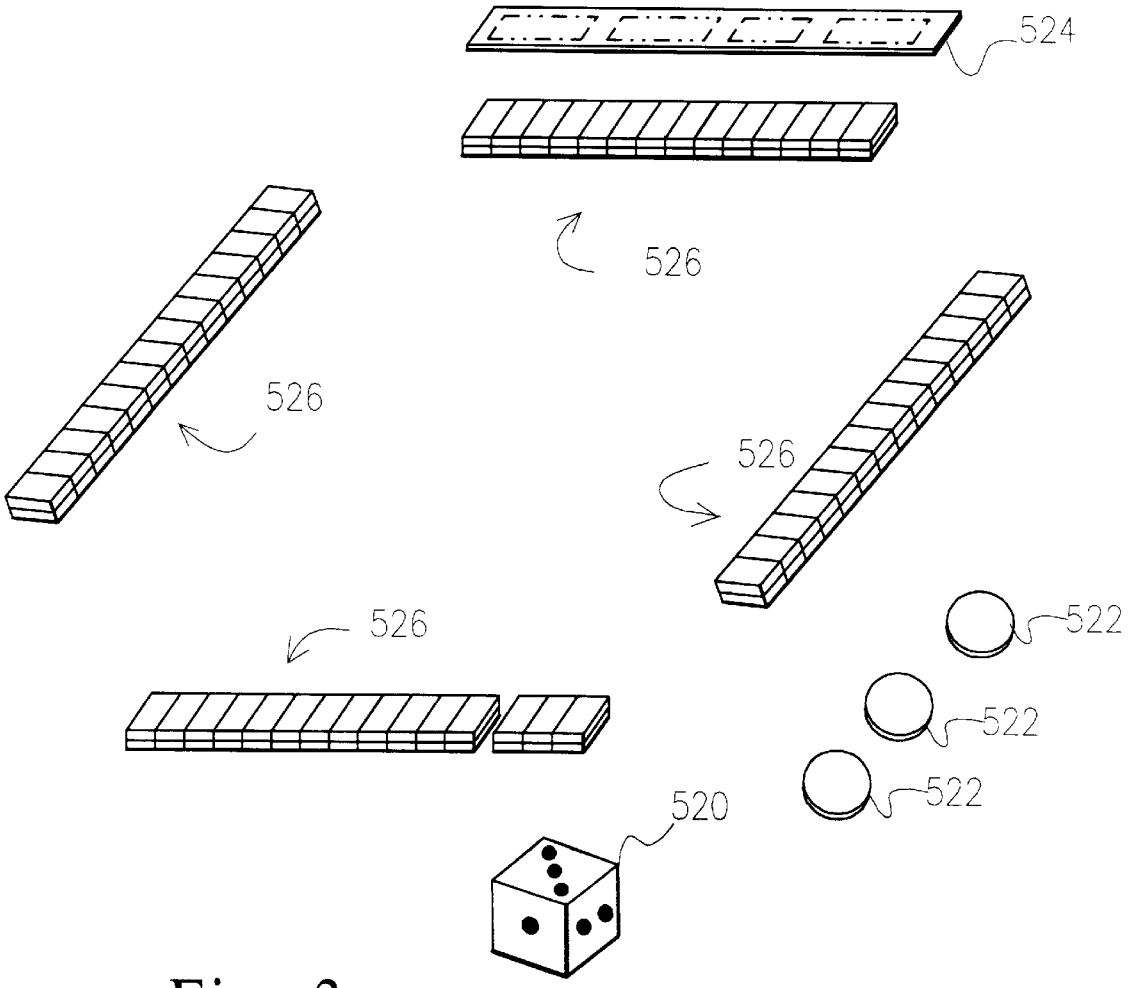
FIG. 3 is a pictorial illustration showing an isometric view of the game pieces of the present invention as used when playing amongst four players.
Figure 4:
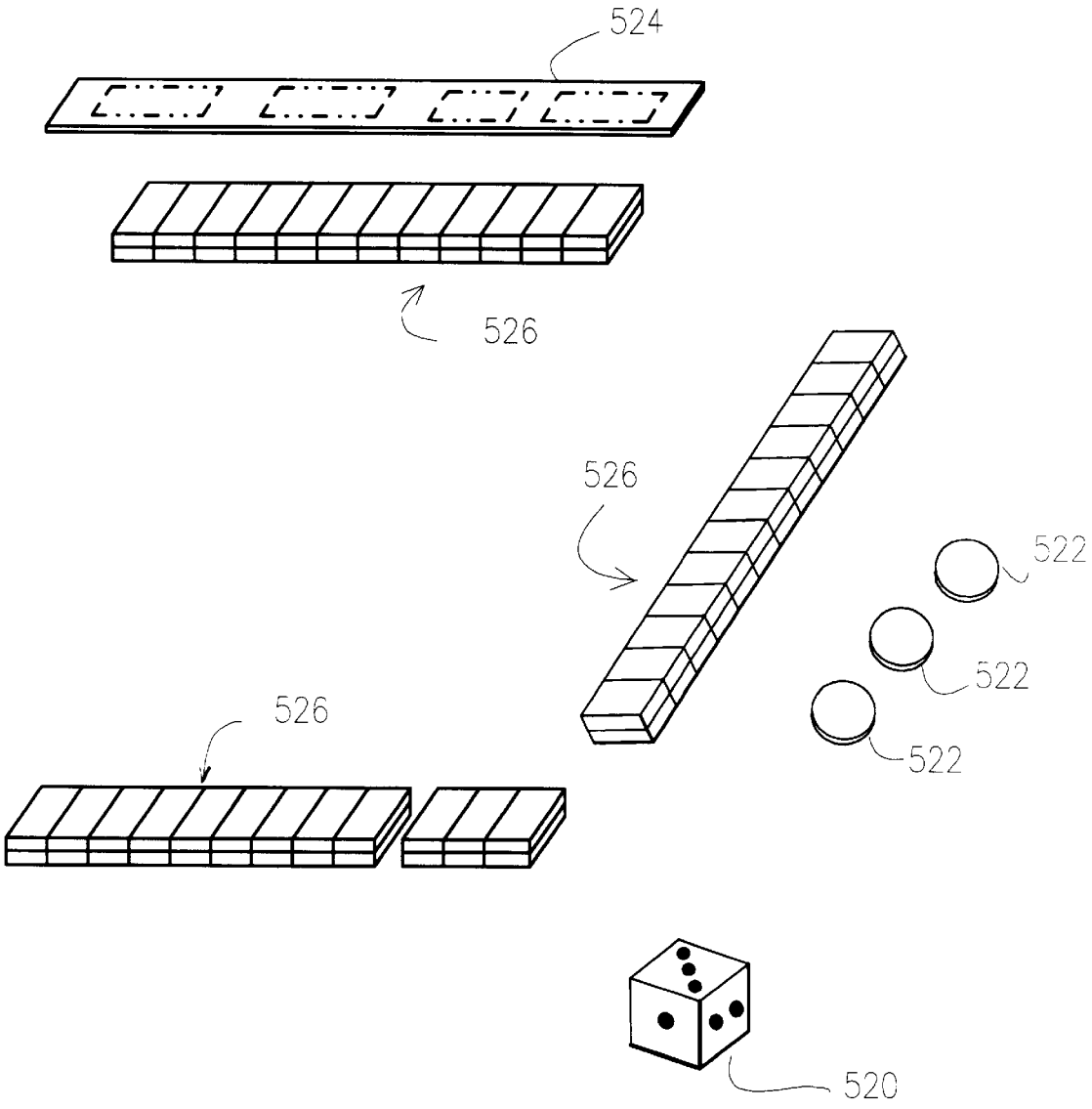
FIG. 4 is a pictorial illustration showing an isometric view of the game pieces of the present invention as used when playing amongst three players.
Figure 5:
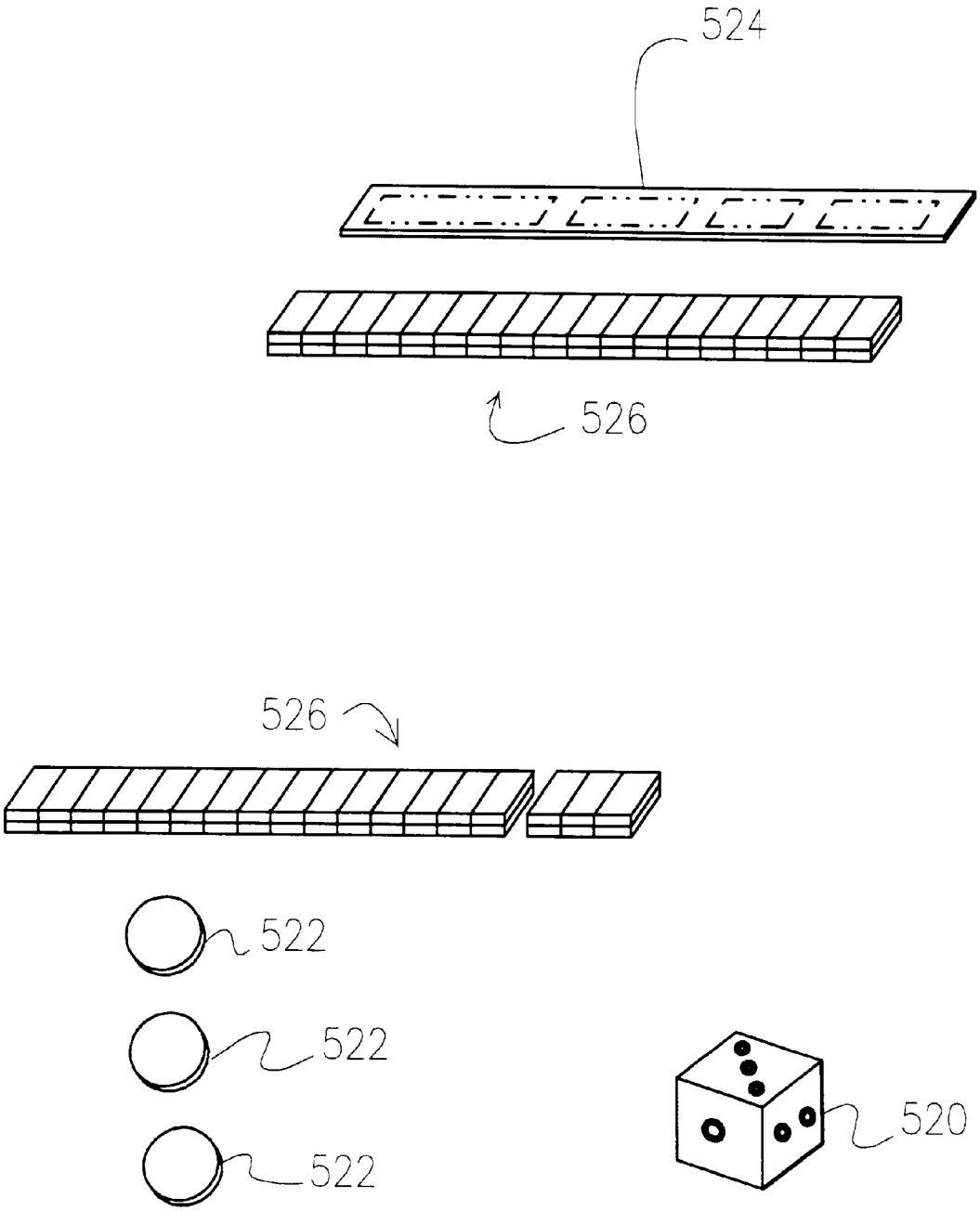
FIG. 5 is a pictorial illustration showing an isometric view of the game pieces of the present invention as used when playing amongst two players.

To play a game with four players, all 112 tiles are mixed together face down. The tiles are then divided up into four groups having 28 tiles in each group. Each player should then receive one group of 28 tiles and stack the tiles face down in the shape of a row or stack 526 that is 14 tiles long and two tiles high. In order to facilitate the forming of these stacks 526, the rulers 524 can preferably include markers that correspond to the width of 14 tiles that have been laid side to side and indicia that reminds the player of the point values for the combos discussed herein. The rulers 524 are used as shown on FIGS. 3 through 5 where the user aligns the ruler in a parallel fashion with the stack and uses the ruler to aid the player in counting the desired number of tiles in the stack.

Once the rows 526 have been formed, a person who has been designated as the first player cuts or divides the row in front of her. The cut is accomplished by simply rolling the die to obtain a number that represents the position where the first player is to divide her row or stack 526 of tiles. As has been illustrated in FIG. 3, if the first player rolls a three, for example, then she would count three tiles from the right end of the stack facing the first player and separate out these six tiles (each stack 526 is two tiles high). The first player then draws the next four tiles that are immediately to the left of the cut and places them in front of her in a manner that will not allow others to see the face of the tiles.

After the first player has picked up these four tiles from the row in front of her, the player who is seated at her right then draws four tiles from the balance of the stack 526 of tiles in front of the first player. Then second player also assembles the tiles in front of her in a manner that does not allow others to see the face of the tiles she drew. The process continues with the third player, who is seated to the right of the second player. The third player then draws the next four tiles from what remains of the stack in front of the first player. The fourth player does the same as the previous player, unless the stack 526 in front of the first player has been exhausted. If the stack in front of the first player has been exhausted the player then draws from the stack 526 in front of the player that is to the right of the first player, in other words, in front of the second player.

The above process for drawing four tiles at a time is repeated. After each player has drawn eight tiles each player then draws two more tiles following the same order that was used in drawing the first eight tiles.

After each player has drawn ten tiles, the first player will then draw two more tiles, and the rest of the players will draw only one tile. These tiles are picked up in the same order as the first ten tiles. At this point the first player should have 12 tiles, and all other players should have eleven tiles each. The set of tiles distributed to each of the players is called a "hand." The remaining stacks 526 with undistributed tiles define a "bank" of tiles.

Therefore, after obtaining their first hand, each player privately studies his or her tiles to determine if they have any of the "lucky" tiles 518. If they have any "lucky" tiles 518, these should be turned over or "laid down" and exposed during the player's next turn. Therefore, when the game starts the first player declares whether she has any "lucky" tiles 518 and proceeds to lay down these tiles, leaving them face up on the playing surface. She will be awarded one point for each of the "lucky" tiles 518. Then the first player must substitute the "lucky" tiles 518 laid down by drawing new tiles from the bank. This process is repeated with the next player. Therefore, the second player, who sits to the right of the first player, then declares whether she has any "lucky" tiles 518. If she has any lucky tiles she must then expose these tiles by laying them face up in front of her. She will be awarded one point for each "lucky" tile laid down and will also have to replace the "lucky" tile or tiles 518 by drawing tiles from the bank.

Players can form combos from the 11 tile hand that was initially distributed to each player. If the player's original hand did not make the player an instant winner, then she can try to assemble a winning hand. To assemble a wining hand a player must discard tiles that do not help the player assemble combos and must try to substitute these tiles with new tiles that help the player in forming combos. A player can obtain new tiles in one of three following ways, (1) by drawing new tiles from the bank; (2) by "picking up" tiles discarded by the player who played immediately before the player who now seeks a new tile; and, (3) by "taking" tiles whenever possible.

As used herein, when a player "draws" a tile he or she simply selects the next available tile from the bank. When a player "picks up" a tile, he or she is claiming the tile that had just been discarded by the player immediately before him or her. When a player "takes" a tile, he or she is claiming a tile that has just been discarded by another player and that player will use the tile just taken to assemble a combo called a "triplet." Triplets are combos that are made up of identical tiles.

If no player has collected all four "lucky" tiles 518, the first player to assemble a hand that is made up entirely of combos is the winner for that round and is awarded points according to the points schedule included below. No other player will be able to earn points for that round, regardless of how many combos they have in their hand. Points will be awarded, however, for "lucky" tiles 518 drawn.

Therefore, when playing the game each player will try to be the first to assemble a winning hand by exchanging the unwanted tiles in their hand. The exchange will be accomplished by drawing, picking up, or taking. When a player obtains a new tile, the new tile will bring the total number of tiles in the possession of that player to 12 tiles. Therefore, unless the 12th tile is the tile that allows the player to win by forming four sets of combos (each having three tiles), she must discard one tile in order to bring the number of tiles in her possession back down to 11 tiles.

The tile that is discarded must be discarded with its face up. Once it is discarded the another player may claim the discarded tile. Tiles that have been discarded may be claimed by another player who "takes" or "picks up" the tile to form a combo. If the tile is not immediately picked up or taken in the play that comes immediately after the tile was discarded, then the tile becomes a "dead" tile and may not be used again.

The game continues in a counterclockwise order until one of the players forms a hand that is made up entirely of combos. A player who draws a tile from the bank may draw a tile that furthers the forming of combos, does nothing towards the forming of combos, or is a "lucky" tile 518. In the event that a player draws a lucky from the bank, that player must lay down the lucky face up and draw another tile. The new tile drawn will bring the number of tiles in the possession of the player to a total of 12 tiles. Therefore, unless the tile just drawn makes the player a winner, the player must discard one of the tiles in order to bring the number of tiles in the possession of the player back down to 11 tiles.

The tile that is discarded must be discarded with its face up. Once it is discarded the next player may pick up the discarded tile, or another player who needs the tile to form a triple may take the tile. If a player takes the discarded tile, the game will continue to the right of player who just took. Any player between the player who discarded the tile and the player who took the tile is simply skipped.

Therefore taking causes the game to proceed out of order by a player who needs the tile that was just discarded in order to form a combo having three identical tiles. The player who "takes" must then lay down the three identical tiles face up. The three tile combo is said to be "melded" and will remain face up, separated from the rest of the player's hand, for the reminder of the round.

The game continues in a counterclockwise order until one of the players forms a hand that is made up entirely of combos. A player who draws a tile from the bank may draw a tile that furthers the forming of combos, does nothing towards the forming of combos or is a "lucky" tile 518. In the event that a player draws a lucky from the bank , that player must lay the lucky down face up and draw another tile. The new tile drawn will bring the number of tiles in the possession of the player to a total of 12 tiles. Therefore, unless the tile just drawn makes the player a winner, the player must discard one of the tiles in order to bring the number of tiles in the possession of the player back down to 11 tiles.

As will become clear from the points schedule included immediately below, points are earned depending on the kinds of combos that are grouped. Also, one point will be awarded for each "lucky" tile 518. In a preferred embodiment the following combos are worth one point when part of a complete hand (a hand that is made up entirely of combo's):

1) a group of three identical tiles that was formed with tiles drawn from the bank (not by "taking" or "picking up"), this kind of group is referred to herein as a "concealed triplet";
2) a group of two or three "triplets" formed by "taking" or "picking up," these kinds of combos are called "melded triplets";
3) a wining hand that can only be completed by a specific tile. For example, the hand has three combos and two tiles of the same suit, one having the number one and the other having the number two. The only way to win is by drawing a tile of the same suit and having the number three. This kind of wining hand is called "only choice";
4) four identical tiles, which are used to form two different combos. For example, a hand has four tiles of the same suit and having the number seven, the winning player will be awarded one point for forming a combo having three sevens of the same suit and a combo that includes the remaining seven (for example in a combo of the same suit having tiles numbered five, six, and the fourth tile that has the number seven). This kind of arrangement is called "four in two";
5) if the winning hand was formed entirely form tiles drawn from the bank. In other words, the player did not "take" or "pick up" any of the tiles. This kind of hand is called a "clean hand";
6) if all four combos, therefore all 12 tiles, are sequence combos. This means that each of the combos must be a sequence combo. This kind of hand is called a "four sequence";
7) if none of the combos contain a one (1) or a nine (9). Therefore, all of the combos in the hand have numbers that are from two (2) to eight (8) and can have varied suits or be sequence combos or triplet combos. This kind of wining hand is called an "endless" hand; and
8) if all combos are formed from tiles that are of two suits. In other words only two suits can be found in the hand. This kind of hand is called "two suits."

The following combos or hands are worth two points when part of a complete hand:

1) a pair of identical sequence combos. In other words, two combos having the same numbers and the same suit. This kind of pair is called a "twin";
2) if all four combos contain either a nine (9) or a one (1). This kind of hand is called "ends only"; and
3) if all four combos have one number in common regardless of suit. This kind of hand is called "link one."

The following combos or hands are worth three points when part of a complete hand:

1) if three of the combos have the same numerical values but all are of different suits. For example, all three combos have the numbers 3, 4, and 5 but each combo is in a different suit. This kind of hand is called the "sisters";
2) if the hand contains three combos of the same suit and the three combos include the numbers 1 through 9. This kind of set within a hand is called a "string";
3) if all four combos have the same suit. This kind of hand is called a "happy family";
4) if all four combos have two numbers in common. This kind of hand is called "link two."

The following combos or hands are worth four points when part of a complete hand:

1) if all four combos are made up of identical tiles, in other words, the hand is made up of four triplets;
2) if all four combos have the same numerical values. For example if all four combos have the numbers 3, 4, and 5, regardless of whether they are of the same suit. This kind of hand is called "link three"; and
3) if you draw all four "lucky" tiles 518, regardless of whether the hand has any other combos.

Because the game is played in rounds, it can be played for as many rounds as is desired. Each round begins with the shuffling and distributing of the tiles as described earlier and ends when one person has drawn all four "lucky" tiles 518 or has formed four sets of combinations of tiles or "combos." Points are awarded for as many of the above combinations that can be identified in the hand of the first person to form a hand that is made up entirely of combos, and except for the "lucky" tiles 518 no points are awarded for combos in the hands of the remaining players.

The game 510 can also be played with two or three players. To play with three players the number of tiles used is reduced by eliminating one of the suits. Therefore, if the third set of 36 tiles 516 is set aside for playing, the first set of 36 tiles 512, and the second set of 36 tiles 514 remain for a total of 72 tiles for play.

In order to form the bank with three players, three rows, each twelve tiles long and two tiles high should be formed. The first player should then roll the die 520 in order to establish the cut. As shown on FIG. 4, for example, if the die reveals a three, then the cut is made at three pairs of tiles from the right end of the row in front of the first player. The tiles are then distributed, beginning with the first player receiving the first stack of four tiles that follow to the left of the cut, the second player receiving the second stack of four tiles, and third player the third stack of four tiles. The process is repeated until all players have eight tiles, and then the first player picks up one more tile. This means that at the beginning of the game the first player will have nine tiles and the rest of the players will have eight tiles.

When two individuals play the game, the rules and process are unchanged. The object still is to win rounds by being the first player to hold a hand that is made up entirely of combos. The same 72 tiles are used as was used when playing amongst three players. However, when forming the bank for two players, two rows, each eighteen tiles long and two tiles high should be formed. The first player should then roll the die in order to establish the cut. As shown on FIG. 5, for example, if the die reveals a three, then the cut is made at three pairs of tiles from the right end of the row in front of the first player. The tiles are then distributed, beginning with the first player receiving the first stack of four tiles that follows to the left of the cut, the second player receiving the second stack of four tiles, and so on. The process is repeated distributing stacks of four until all players have eight tiles, and then the first player picks up one more tile. This means that at the beginning of the game the first player will have nine tiles and the rest of the players will have eight tiles.

The objects and process used to earn points are not altered when playing with three players. However, when playing with two or three players the "lucky" tiles 518 are no longer used. Also, when playing among two players, the rules allowing the picking up and taking are obviated. Moreover, because all of the combos are defined in sets of three and the player's hand is now based on a multiple of three, the same rules can be applied in most situations except as indicated below. With regards to the one point combos defined above, the following changes are made:

1) with regards to the point available for four sets in sequence available when playing with four players (rule 7 for one point combos, above), now one point will be awarded for forming a sequence of three combos that are numbered in sequence regardless of suit; and
2) with regards to the point available for having all tiles being of one of two suits (rule 9 for one point combos, above) is not applicable when playing among two or three people.

The rules for two point combos do not change when playing amongst two or three people.

With regards to the rules for awarding three points, the sisters combo, where three points are awarded for three combos having the same numerical value but having three different suits, is not applicable when playing amongst two or three players because only two suits are used when playing with less than four players.

With regards to the rules for awarding four points, four points are awarded to three sets of triplet combos, instead of four sets of triplet combos as is done when playing amongst four players.

When a player wins a round, he or she gets to collect chips from all of the losing players. In a preferred method of playing the winner of a round collects one chip from each player for each point in the winning hand.

Alternatively, when playing amongst beginners and the players want to simplify the rules for scoring, the players may simply only include rewards for beating the odds when forming the winning hand. For example, if a winner of a round draws the winning tile from the bank instead of taking a tile that had just been discarded, then the other players must pay the winner two chips. If the winner of a round completes her hand by picking up or taking a tile, then the person that discarded the tile must pay the winner two chips and the other players must pay the winner one chip. Still further, if the winner forms the winning hand by drawing all tiles from bank, then all of the other players must pay three chips to the winner.

In yet another variation of the method of playing, players may choose to increase the difficulty of winning by requiring a minimum point value of the winning hand. For example, the players may agree that to win a round the point value of the combos must be at least three, so the winner of a particular round would have to be the first to complete four combos that are worth a total of at least three points.

Another variation in the method of playing includes awarding one point for any combo in the winning hand. This variation would be particularly beneficial when playing amongst beginners.

Thus it can be seen that the difficulty of game can be increased depending on the skill and choosing of the players.

Moreover, the game combines skill and chance, so that the game can be won those with less skill than other players. Moreover, the role of chance keeps the game lively regardless of the skill of the players.

Accordingly, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A game aparatus whose object is to be the first player to combine and hold only groups of related tiles, the game apparatus comprising:

a first set of 36 tiles comprising four sets of a first series of nine tiles, each tile having a face with an icon of a first series of related icons and a numerical value;

a second set of 36 tiles comprising four sets of a second series of nine tiles, each tile having a face with an icon of a second series of related icons and a numerical value;

a third set of 36 tiles comprising four sets of a third series of nine tiles, each tile having a face with an icon of a third series of related icons and a numerical value;

a set of four tiles having an icon and designated as trump tiles, so that players may win by using the trump tiles as well as by assembling groups of three tiles related by icon and numerical value; and at least one ruler means for counting and aiding players in determining the points awarded for combining related tiles.

2. A game according to claim 1 wherein the first series of related icons includes icons having the image a baseball player.

3. A game according to claim 2 wherein the second series of related icons includes icons having the image a baseball.

4. A game according to claim 2 wherein the third series of related icons includes icons having the image a number represented with an equivalent number of baseball bats.

5. A game according to claim 1, and further comprising at least one means for random number generation.

6. A game according to claim 5 wherein said means for random number generation is a die.

7. A game according to claim 6, and further comprising means for keeping score.

8. A method of playing a game amongst at least two players, the method comprising:

providing a set of seventy two tiles comprising:

a first set of 36 tiles comprising four sets of a first series of nine tiles, each tile having a face within icon of a first series of related icons and a numerical value;

a second set of 36 tiles comprising four sets of a second series of nine tiles, each tile having a face with an icon of a second series of related icons and a numerical value;

distributing nine randomly selected tiles from the set of seventy two tiles to one of the players and eight randomly selected tiles to the rest of the players;

discarding an unwanted tile from the nine tiles held by one of the players;

taking turns in selecting a ninth tile from the remaining undistributed tiles or from the most recently discarded tile and discarding an unwanted tile;

providing rulers having markings for aiding the player in the counting of the number of tiles held by a player and for aiding the player in how to use the ninth tile to complete three sets of three related tiles;

counting with the markings on the rulers the number of tiles held by a player;

comparing the markings on the rulers with the ninth tile to aid the player in completing three sets of three related tiles; and awarding points to the first player to use the ninth tile to complete three sets of three related tiles.

9. A method of playing a game according to claim 8 and further comprising the step of repeating the steps of:

distributing nine randomly selected tiles from the set of seventy two tiles to one of the players and eight randomly selected tiles to the rest of the players;

allowing the player with nine tiles to discard an unwanted tile;

allowing the players to take turns in selecting a ninth tile from the remaining undistributed tiles and from the most recently discarded tile and discarding an unwanted tile; and awarding points to the first player to use the ninth tile to complete three sets of three related tiles.

10. A method of playing a game amongst four players, the method comprising:

providing a set of one hundred and twelve tiles comprising:

a first set of 36 tiles comprising four sets of a first series of nine tiles, each tile having a face with an icon of a first series of related icons and a numerical value;

a second set of 36 tiles comprising four sets of a second series of nine tiles, each tile having a face with an icon of a second series of related icons and a numerical value;

a third set of 36 tiles comprising four sets of a third series of nine tiles, each tile having a face with an icon of a third series of related icons and a numerical value; and a set of four tiles having an icon, trump value and no numerical value;

providing rulers having markings for aiding the player in the counting of the number of tiles held by a player and having a points schedule for aiding the player in determining the points awarded to the player when the player completes sets of related tiles;

distributing eleven randomly selected tiles to three of the players and twelve tiles to the one of the players;

discarding an unwanted tile from the twelve tiles held by one of the players;

taking turns in selecting a twelfth tile from the remaining undistributed tiles or from the most recently discarded tile and discarding an unwanted tile;

counting with the markings on the rulers the number of tiles held by a player;

comparing the markings on the rulers with the twelfth tile to aid the player in completing three sets of three related tiles; and awarding points to the first player to use the twelfth tile to complete four sets of three related tiles and for obtaining tiles from the set of four tiles having an icon, trump value and no numerical value.

11. A method of playing a game according to claim 10 and further comprising the step of repeating the steps of:

distributing eleven randomly selected tiles to three of the players and twelve tiles to the one of the players;

allowing the player with twelve tiles to discard an unwanted tile;

allowing the players to take turns in selecting a twelfth tile from the remaining undistributed tiles and from the most recently discarded tile and discarding an unwanted tile, and awarding points to the first player to use the twelfth tile to complete four sets of three related tiles and for obtaining tiles from the set of four tiles having an icon, trump value and no numerical value.

12. A method of playing a game according to claim 11 and further comprising the step of awarding at least one point for every tile selected having an icon, trump value and no numerical value.

* * * * *